US005743830A

United States Patent [19]

Ho

[11] Patent Number: 5,743,830

[45] Date of Patent: Apr. 28, 1998

[54] TORSION EXERCISE DEVICE FOR ARM AND WRIST

[76] Inventor: Ko Ching Ho, P.O. Box 453, Taichung, Taiwan

[21] Appl. No.: 884,009

[22] Filed: Jun. 27, 1997

[51] Int. Cl.[6] ..... A63B 21/02

[52] U.S. Cl. ..... 482/44; 482/126; 482/122; 482/127

[58] Field of Search ..... 482/44, 121, 122, 482/126, 127

[56] References Cited

U.S. PATENT DOCUMENTS 4,557,479 12/1985 Guibert ..... 482/44
5,445,581 8/1995 Ferber ..... 482/44
5,507,712 4/1996 Chang ..... 482/127
5,536,223 7/1996 Ferber ..... 482/44

*Primary Examiner*—Lynne A. Reichard

[57] ABSTRACT

An exercise device is intended for developing arm and wrist, and is composed of a joint seat, a joint housing, a bearing member, an elastic element, two handlebars, and two torsion-resisting elements. The joint seat, the joint housing and the bearing member are fastened coaxially and pivotally in conjunction with the elastic element. The joint seat and the joint housing are provided with a handlebar fastened therewith. The torsion-resisting elements are located in the handlebars such that one end of the torsion-resisting element is retained by the joint housing or the joint seat, and that another end of the torsion-resisting element is retained by the handlebar.

2 Claims, 5 Drawing Sheets

TORSION EXERCISE DEVICE FOR ARM AND WRIST

FIELD OF THE INVENTION

The present invention relates generally to an exercise device, and more particularly to a device for exercising a person's arms and wrists.

BACKGROUND OF THE INVENTION

There are a variety of exercise devices designed for use in developing the arms and the wrists of an exerciser. Such conventional exercise devices as referred to above are generally defective in design in that they are rather cumbersome, and that they take up a large floor space, and further that they can not be used easily without inflicting a bodily injury on the user thereof, and still further that they are not cost-effective.

SUMMARY OF THE INVENTION

The primary objective of the present invention is to provide a torsion exercise device for developing the arms and the wrists of a person. The torsion device of the present invention is free from the drawbacks of the conventional exercise devices intended for exercising a person's arms and wrists.

The torsion device of the present invention is mainly composed of a joint housing, a joint seat, a bearing member, an elastic element, two handlebars, and two torsion-resisting elements. The joint housing, the joint seat and the bearing member are fastened pivotally and coaxially, in conjunction with the elastic element. The joint housing and the joint seat are provided respectively with a handlebar fastened therewith. The handlebar is provided with the torsion-resisting element.

The foregoing objective, features and functions of the present invention will be more readily understood upon a thoughtful deliberation of the following detailed description of an embodiment of the present invention with reference to the accompanying drawings.

DETAILED DESCRIPTION OF THE EMBODIMENT

Figure 1:
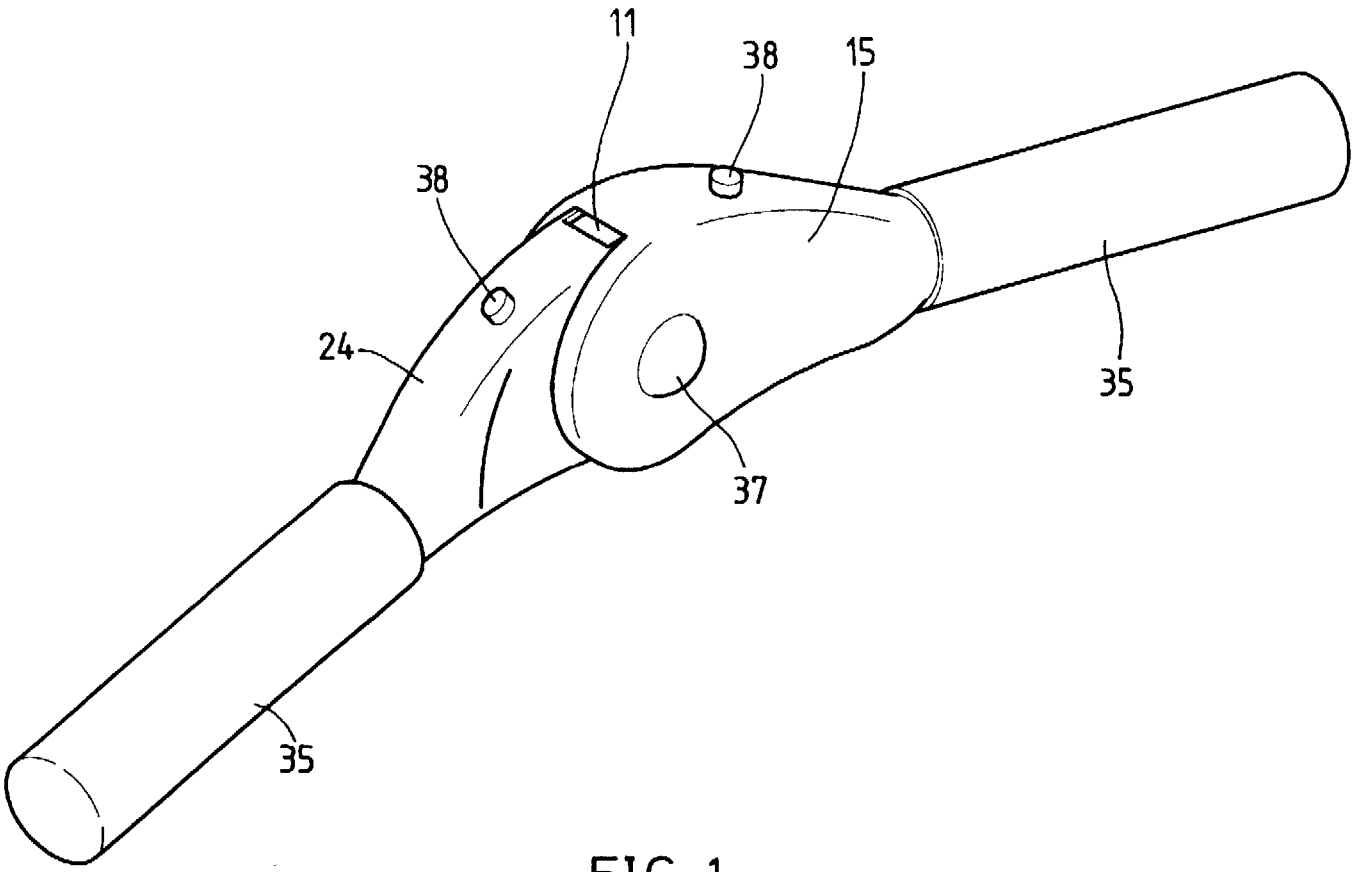
FIG. 1 shows a perspective view of the embodiment of the present invention.
Figure 2:
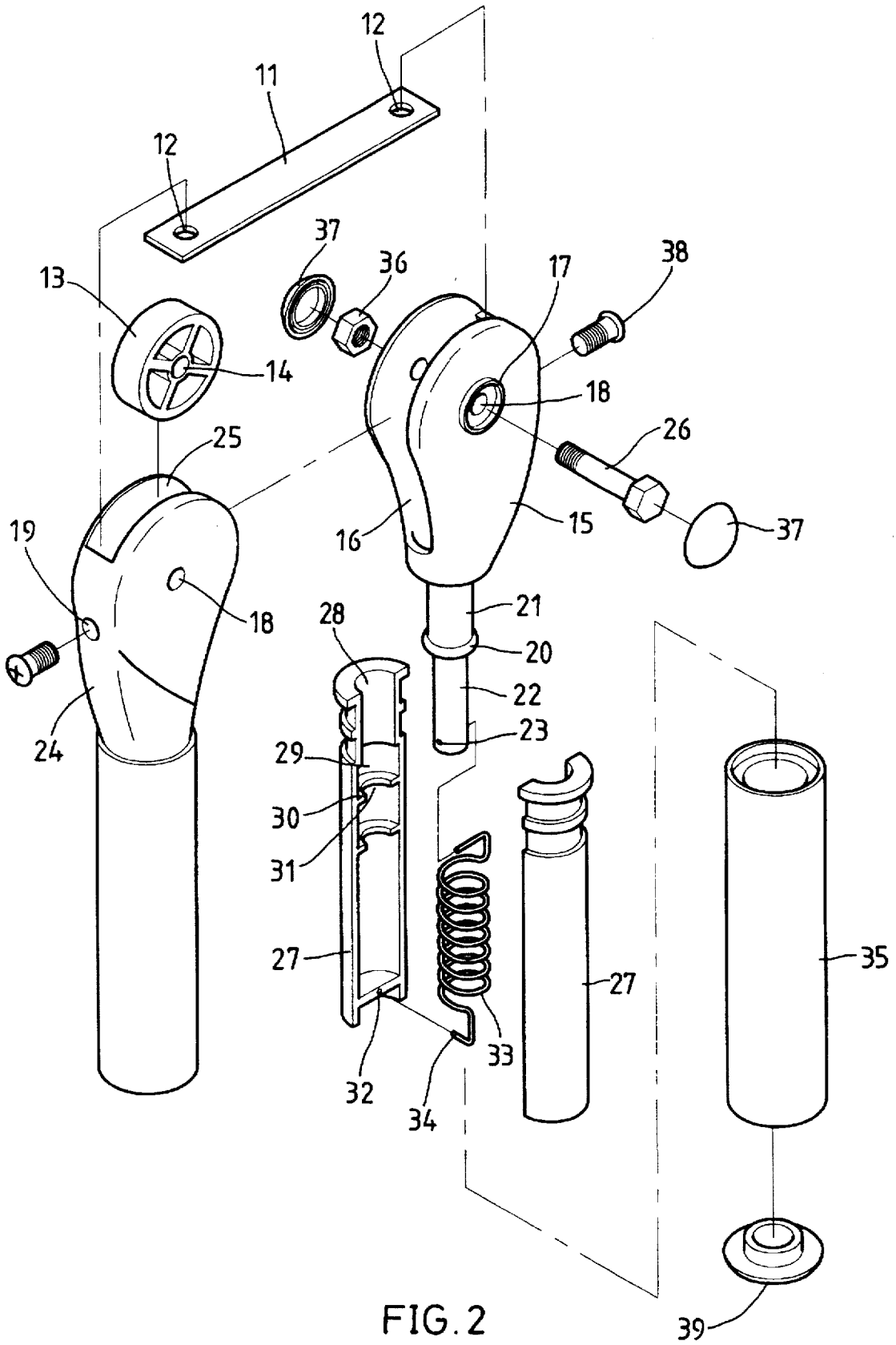
FIG. 2 shows an exploded view of the present invention as shown in FIG. 1.
Figure 3:
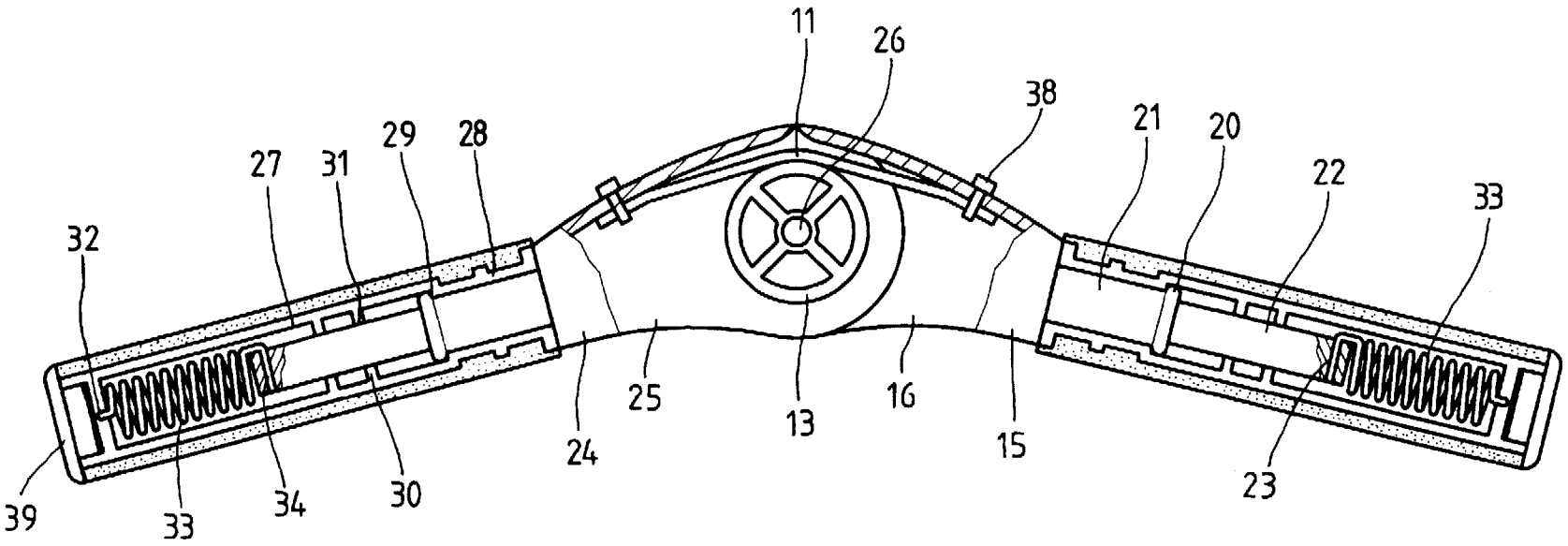
FIG. 3 shows a longitudinal sectional view of the present invention in combination.

As shown in FIGS. 1–3, an exercise device embodied in the present invention is composed of an elastic element 11, a bearing member 13, a joint housing 15, a joint seat 24, a shaft 26, two handlebars 27, two torsion-resisting elements 33, and two soft jackets 35.

The elastic element 11 is of an elongated platelike construction and is provided respectively at both ends thereof with a fastening hole 12.

The bearing member 13 Is of a circular construction and is provided with a center hole 14.

The joint housing 15 is provided with a receiving seat 16, a circular rib 17 having an axial hole 18, a locating hole 19, an extension portion 21 having a protruded edge 20, and a rod 23 having a through hole 22.

The joint seat 24 is provided with a seat body 25 having an axial hole 18 and a locating hole 19. The joint seat 24 is similar in construction to the joint housing 15 in that the joint seat 24 is also provided with an extension portion 21 having a protruded edge 20, and a rod 23 having a through hole 22.

A shaft 26 is engaged with the axial holes 18 of the joint housing 15 and the joint seat 24, as well as the center hole 14 of the bearing member 13. In other words, the bearing member 13, the joint housing 15 and the joint seat 24 are mounted coaxially on the shaft 26.

The handlebars 27 are provided respectively with a shaft seat 28, a stopping edge 29, an inner cross rib 30 having an arcuate edge 31, and an outer cross rib 30 having an insertion hole 32.

Two torsion-resisting elements 33 are provided with two hooks 34.

Two soft jackets 35 are used to fit over the handlebars 27.

As shown in FIG. 3, the bearing member 13 is located in the seat body 25 of the joint seat 24, which is in turn located in the receiving seat 16 of the joint housing 15. In other words, the bearing member 13, the joint housing 15 and the joint seat 24 are fastened coaxially and pivotally by the shaft 26 which is engaged with the axial holes 18 of the joint housing 15 and the joint seat 24, as well as the center hole 14 of the bearing member 13, in conjunction with a nut 36 and a cap 37. The elastic element 11 is located in such a manner that it traverses the bearing member 13, and that it is located by two locating bolts 38 which are engaged with the fastening holes 12 of the elastic element 11 and the locating holes 19 of the joint housing 15 and the joint seat 24.

The torsion-resisting elements 33 are mounted in the handlebars 27 such that one hook 34 of the elements 33 is retained by the insertion hole 32 of the handlebar 27. The handlebars 27 are fastened respectively with the extension portion 21 of the joint housing 15 or the joint seat 24 such that another hook 34 of the torsion-resisting elements 33 is retained securely by the through hole 22 of the rod 23 of the joint housing 15 or the joint seat 24. The handlebars 27 are provided respectively at the free ends thereof with a decorative plug 39 fastened therewith.

Figure 4:
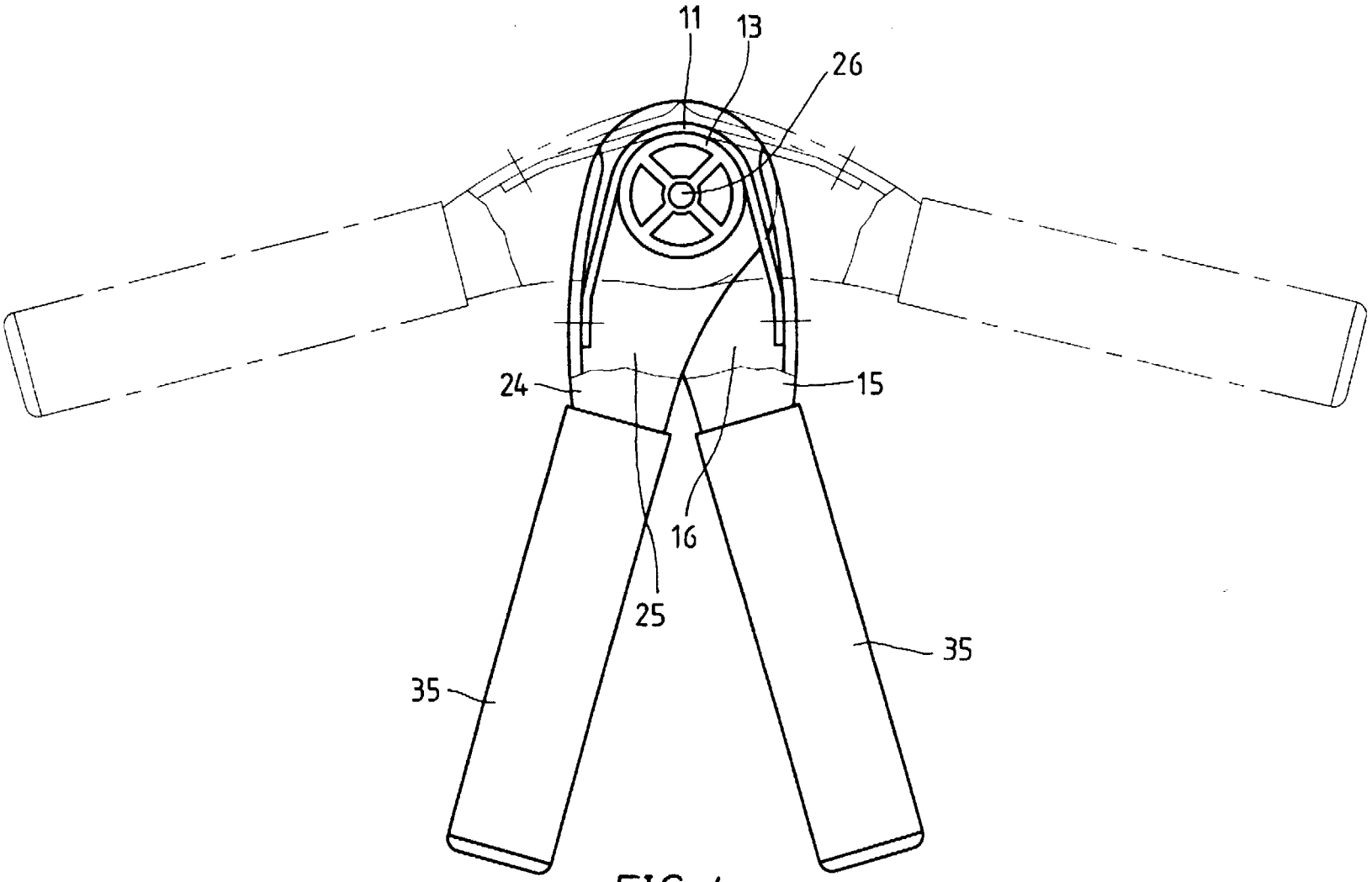
FIG. 4 shows a schematic view of the present invention at work.

The handlebars 27 are provided respectively with the soft jacket 35 for affording a user of the device a comfortable grip. The handlebars 27 are held by both hands of the user of the device and can be forced to move towards each other, as illustrated in FIG. 4. Such a movement of the handlebars 27 as described above is attained only when the resisting force of the elastic element 11 is overcome by the force of both hands of the user of the device. The arm-developing exercise is thus accomplished by the device of the present invention.

Figure 5:
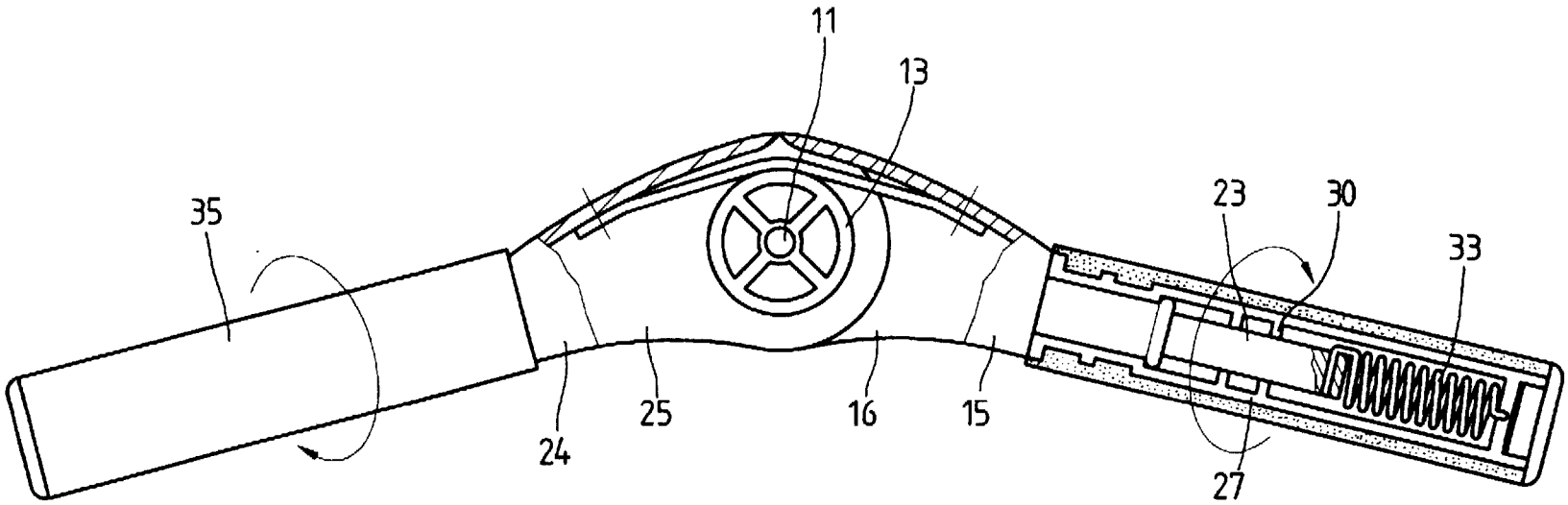
FIG. 5 shows another schematic view of the present invention at work.

As illustrated in FIG. 5, the device of the present invention can be used for the wrist-developing exercise. The handlebars 27 can be rotated by both hands of the user of the device in opposite directions indicated by the arrows in FIG. 5. The handlebars 27 can be twisted successfully by both hands of the exerciser only when the torsion-resisting force of the torsion-resisting elements 33 is overcome.

The embodiment of the present invention described above is to be deemed in all respects as being merely illustrative and not respective. Accordingly, the present invention may be embodied in other specific forms without deviating from the spirit thereof. The present invention is therefore to be limited only by the scope of the following appended claim.

What is claimed is:

1. An exercise device for developing arm and wrist, said exercise device comprising:

an elastic element having two ends provided respectively with a fastening hole;

a bearing member of a circular construction and having a center hole;

a joint housing provided with a receiving seat, an axial hole, a locating hole, and an extension portion of a rodlike construction;

a joint seat provided with an axial hole, a locating hole, and an extension portion of a rodlike construction;

a shaft engaged with said axial hole of said joint housing, said axial hole of said joint seat and said center hole of said bearing member such that said joint housing, said joint seat and said bearing member are fastened coaxially and pivotally by said shaft, and that said two fastening holes of said elastic element are engaged with two locating bolts which are also engaged with said locationg holes of said joint housing and said joint seat; and two handlebars of a hollow construction and provided respectively therein with a torsion-resisting element having two ends which are provided with a retaining hook, one of said two handlebars being fastened with said extension portion of said joint housing such that said retaining hook of one of said two ends of said torsion-resisting element is engaged with a through hole of said extension portion of said joint housing, and that said retaining hook of another one of said two ends of said torsion-resisting element is engaged with an insertion hole of said one of said two handlebars, another one of said two handlebars being fastened with said extension portion of said joint seat such that said retaining hook of another one of said two ends of said torsion-resisting element is engaged with a through hole of said extension portion of said joint seat, and that said retaining hook of another one of said two ends of said torsion-resisting element is engaged with an insertion hole of said another one of said two handlebars.

2. The exercise device as defined in claim 1, wherein said two handlebars are provided with a jacket fitted thereover for providing a user of the exercise device with a comfortable grip.

* * * * *